US009803415B2

(12) United States Patent
Ferri et al.

(10) Patent No.: US 9,803,415 B2
(45) Date of Patent: Oct. 31, 2017

(54) SPACER FOR INSULATING GLAZING UNIT

(71) Applicant: Quanex IG Systems, Inc., Cambridge, OH (US)

(72) Inventors: Louis Anthony Ferri, Solon, OH (US); Tracy G. Rogers, Dover, OH (US); Larry Johnson, Dover, OH (US); Qingyu Zeng, Solon, OH (US); Kevin Zuege, Aurora, OH (US); Ronald Ellsworth Buchanan, Zanesville, OH (US); James Lynn Baratuci, Stow, OH (US); Leslie M. Canning, Jr., Cambridge, OH (US); Tim Harris, Solon, OH (US); William James Hartle, Vermilion, OH (US); Kenneth Wayman, Port Washington, OH (US)

(73) Assignee: Quanex IG Systems, Inc., Cambridge, OH (US)

( * ) Notice: Subject to any disclaimer, the term of this patent is extended or adjusted under 35 U.S.C. 154(b) by 0 days.

(21) Appl. No.: 14/403,796

(22) PCT Filed: May 29, 2013

(86) PCT No.: PCT/US2013/043124

§ 371 (c)(1),
(2) Date: Nov. 25, 2014

(87) PCT Pub. No.: WO2013/181257

PCT Pub. Date: Dec. 5, 2013

(65) Prior Publication Data

US 2015/0233173 A1 Aug. 20, 2015

Related U.S. Application Data

(60) Provisional application No. 61/652,823, filed on May 29, 2012.

(51) Int. Cl.
*E06B 3/663* (2006.01)

(52) U.S. Cl.
CPC ..... *E06B 3/66328* (2013.01); *Y10T 428/2419* (2015.01); *Y10T 428/24504* (2015.01); *Y10T 428/249983* (2015.04)

(58) Field of Classification Search
CPC ..... E06B 3/66328
(Continued)

(56) References Cited

U.S. PATENT DOCUMENTS 3,971,178 A 7/1976 Mazzoni et al.
4,831,799 A 5/1989 Glover et al.
(Continued)

FOREIGN PATENT DOCUMENTS

EP 2363565 A2 9/2011
WO 0042271 A1 7/2000

OTHER PUBLICATIONS

Oct. 25, 2013 Written Opinion of the International Searching Authority.

(Continued)

*Primary Examiner* — Brent O'Hern
(74) *Attorney, Agent, or Firm* — Zollinger & Burleson Ltd.

(57) ABSTRACT

A flexible spacer body has two opposing faces adapted to engage the inner surfaces of glazing structures to define an insulating glazing unit. The spacer body may be desiccated polymeric foam such as a silicone foam rubber or EPDM. An adhesive capable of bonding the spacer body to the glazing structure is carried by both of the faces. The adhesive may be from about 0.050 mm to about 1.524 mm thick. The adhesive material also has the properties of low argon gas and low moisture permeability. The adhesive comprises polymers where butyl rubber and/or polyisobutylene poly-
(Continued)

mers together make up the majority of the polymers. The adhesive may also comprise other materials as needed to make it pressure sensitive and to impart a water resistant bond to glass glazing structures. The space assembly may include additional materials to secure the adhesive to the spacer body.

26 Claims, 3 Drawing Sheets

(58) Field of Classification Search
USPC ..... 428/121
See application file for complete search history.

(56) References Cited

U.S. PATENT DOCUMENTS

| | | | | |
|---|---|---|---|---|
| 4,950,344 | A | 8/1990 | Glover et al. | |
| 4,994,309 | A | 2/1991 | Reichert et al. | |
| 5,494,715 | A | 2/1996 | Glover | |
| 5,691,045 | A | 11/1997 | Lafond | |
| 6,035,602 | A | 3/2000 | Lafond | |
| 6,266,940 | B1 | 7/2001 | Reichert | |
| 7,141,282 | B2 | 11/2006 | Demars et al. | |
| 7,347,909 | B2 | 3/2008 | Reichert | |
| 7,743,584 | B2 | 6/2010 | Reichert et al. | |
| 2003/0074859 | A1* | 4/2003 | Reichert | E06B 3/66323 52/786.13 |
| 2008/0115877 | A1 | 5/2008 | Reichert | |
| 2009/0120036 | A1 | 5/2009 | Trpkovski | |

OTHER PUBLICATIONS

Dec. 3, 2015 EPO Communication in related application EP 13797331.9.

* cited by examiner

SPACER FOR INSULATING GLAZING UNIT

CROSS REFERENCE TO RELATED APPLICATIONS

This application is a United States National Stage Patent Application filed under 35 U.S.C. §371 claiming priority to PCT/US2013/043124 having an international filing date of May 29, 2013. This application claims the benefit of U.S. Provisional Patent Application 61/652,823 filed May 29, 2012.

BACKGROUND OF THE DISCLOSURE

1. Technical Field

The disclosure generally relates to insulating glazing units and, more particularly, to a flexible spacer that is used to form thermal insulating laminates such as insulating glazing units which are used commercially as windows and doors or as parts of windows and doors.

2. Background Information

The procedure for assembling an insulating glazing unit generally involves spacing two sheets of glazing structures with a desiccated perimeter spacer that may be disposed inwardly from the outer edges of the glazing structures to define a channel that receives sealant. The glazed structures are typically glass sheets, but can also be plastic or other such suitable materials. One flexible spacer that is sold in the marketplace under the Federally Registered trademark SUPER SPACER includes a foam body, a foil moisture vapor barrier, and an acrylic adhesive disposed on its opposed sidewalls. The acrylic adhesive is used to connect the spacer to the glazing structures. A sealant material having a low moisture vapor transmission rate (MVTR) is arranged between the spacer and glazing structures to prevent or minimize the ingress of water vapor into the insulating chamber defined inwardly of the spacer and between the glazing structures. The primary sealant can be made from any self adhering material that has low gas and moisture permeability including polyisobutylene, saran, and epoxy adhesives.

An exemplary prior art insulating glazing unit is shown in FIGS. 1 and 2 to describe an exemplary environment wherein the spacer assembly configurations of the present disclosure may be used. The prior art insulating glazing unit is indicated by the reference numeral 2 and may be used in a variety of window and door applications for buildings and appliances. Insulating glazing unit 2 generally includes a spacer assembly 4 that supports a pair of glazing structures 6 in a spaced configuration to define an insulating chamber between glazing structures 6 and inwardly of spacer assembly 4. In the context of this application, the inward direction is toward the center of this insulating chamber while the outward direction is away from the center of the insulating chamber toward the atmosphere surrounding the insulating glazing unit. Glazing structures 6 are typically clear glass but also may be colored glass, plastic, polymer, or other materials. One or both of glazing structures 6 may be coated with a solar control or low emissivity coating. The insulating chamber is often filled with an insulating gas such as argon or krypton. For good thermal performance, where air or argon gas is used, the optimum spacing between glazing structures is about 12.5 mm.

Spacer assembly 4 includes at least a spacer body 10 and a primary sealant 12. Spacer body 10 typically, but optionally, carries a desiccant. Spacer body 10 is a flexible or semi-rigid foam material manufactured from thermoplastic or thermosetting plastics. Suitable thermosetting plastics include silicone and polyurethane. Silicone foam rubber is a common material for spacer body 10. Suitable thermoplastic materials include thermoplastic elastomers. The advantages of the silicone foam rubber include: good durability, minimal outgassing, low compression set, good resilience, high temperature stability and cold temperature flexibility. A further advantage of the silicone foam rubber is that the material is moisture permeable and so moisture vapor can easily reach the desiccant material within the foam. Spacer body 10 also may be made from cellular material which may be synthetic or naturally occurring. In the instance where the cellular material is composed of a naturally occurring material, cork and sponge may be suitable examples and in the synthetic version, suitable polymers including, but not limited to polyvinyl chlorides, polysilicone, polyurethane, polystyrene among others are suitable examples. Cellular material is desirable because such materials, while providing structural integrity additionally provide a high degree of interstices or voids between the material. In this manner, a high volume of air is included in the structure and when this is combined with an overall insulating material, the air voids complement the effectiveness of the insulation. When the choice of material is not cellular, any number of the high insulating materials known to have utility for the subject matter herein may be selected.

In the context of this application, the primary sealant is the material primarily responsible for preventing moisture vapor from entering chamber 8 between spacer body 10 and glazing structures 6 and preventing gas within chamber 8 from escaping. In this prior art example, spacer body 10 includes a moisture vapor barrier 14 so that primary sealant 12 is only required to seal the area where spacer body 10 is joined to glazing structures 6. Barrier 14 can be a metallic foil, a metallized polymer, or a polymer film having a low MVTR. Spacer assembly 4 optionally includes a secondary sealant 16. The gap between barrier 14 and the inner surface of each glazing structure 6 is sealed with primary sealant 12.

In the exemplary prior art configuration depicted in FIG. 2, spacer 10 also includes a thin acrylic adhesive 18 that is used to connected body 10 to glazing structures 6. Adhesive layer 18 is often 0.0762 mm (0.003 inches) to 0.127 mm (0.005 inches) thick and has a high moisture vapor transmission rate. Although acrylic adhesive 18 is used to form a relatively strong and fast pressure sensitive adhesive connection between spacer body 10 and glazing structure 6 at normal application temperatures, acrylic adhesive 18 has been found to lose adhesive strength at high temperatures and does not provide a significant moisture vapor barrier. Another drawback with the thin adhesive occurs when the faces of the spacer body are not square or when the spacer body varies in width along its length.

SUMMARY OF THE DISCLOSURE

The disclosure provides a flexible spacer body which may be in strip form. The spacer body has two opposing faces adapted to be adhered to the inner surfaces of glazing structures to define an insulating glazing unit. The spacer body may be a thermoplastic or elastomeric foam and may contain a desiccant. The spacer body may be a silicone foam rubber or EPDM. An adhesive capable of bonding the spacer body to the glazing structure is carried by the opposing faces. The adhesive may be from about 0.050 mm (0.002 inches) to about 1.524 mm (0.060 inches) thick. The adhesive material also has the properties of low argon gas and low moisture permeability. The adhesive comprises polymers where butyl rubber and/or polyisobutylene polymers together or alone make up the majority of the polymers. The adhesive may also comprise other materials as needed to make it pressure sensitive and to impart a water resistant bond to glass glazing structures. The adhesive can elongate and stretch without significantly changing in permeability to argon gas or moisture. The strip or spacer body plus the two adhesive layers together form the strip assembly or spacer assembly.

The flexible spacer body is typically extruded and the adhesive may be applied to the two opposing faces immediately downstream or in a subsequent operation. The adhesive may be applied during the manufacture of the spacer assembly or during the manufacture of the insulating glazing unit. The spacer assembly may be coiled for storage. The spacer assembly also may be formed in equipment designed to apply the spacer assembly to the glazing structures with the adhesive layers being applied after the strip is moving through the automated equipment.

The foam spacer body may be covered by a thin skin which is not foam. The skin is thin relative to the dimensions of the spacer body and may be less than 20 percent of the height or width of the spacer body.

When the spacer body is silicone foam rubber, a primer may be used between the adhesive and the spacer body to secure the adhesive to the spacer body. Exemplary primers include Primer 94 by 3M, Chemlok AP-133 by Lord, and Chemlok 607 by Lord.

The spacer assembly may include a layer of acrylic adhesive between the adhesive and the spacer body.

The spacer assembly may include an adhesive tie layer between the adhesive and the spacer body.

The spacer assembly may include a release liner or liners applied to one or both adhesive layers.

The spacer assembly may include a moisture vapor barrier applied to the outwardly-facing surface of the spacer body and opposing faces or portions of the opposing faces of the spacer body such that the barrier extends between the opposing faces.

In one configuration, the spacer assembly is disposed between two parallel glass sheets along the perimeter of said glass sheets such that the adhesive on each opposed face of the spacer body is adhered to one of the glass sheets. The glass sheets with the spacer assembly applied to the perimeter encloses an insulating chamber between the glass sheets. The corners of the spacer assembly may be bent to form corners or notched to facilitate bending at the corners. An additional material which may be a sealant may be applied in the channel formed by the spacer assembly and the edges of the parallel glass sheets.

In another configuration, the adhesive may comprise reactive materials which can react with moisture after application to the glass to increase the modulus of the adhesive or to increase the adhesive force to the glass.

The spacer body is generally more rigid and less deformable than the adhesive. The opposed faces of the spacer body may not be exactly parallel and may be 1 to 10 degrees out of parallel due to manufacturing variances. The adhesive can be applied in non-uniform layer thickness to compensate for the variation in the spacer body such that the outwardly-facing surfaces of the opposing adhesive layers will be closer to parallel than the opposed faces of the spacer body to which they are applied. Adhesive having a thickness of about 0.254 mm (0.010 inches) to about 1.524 mm (0.060 inches) thick provides this compensation ability. This can improve the application of the spacer assembly to the glass sheets. The adhesive also may be used to compensate for geometry variations along the longitudinal length of the spacer body. In these situations, the adhesive is applied to the opposing faces of the spacer body and then passed through a die or a pair of knives to fix the width of the adhesive and square the spacer assembly.

BRIEF DESCRIPTION OF THE DRAWINGS

Similar numbers refer to similar elements throughout the specification. The drawings are not to scale with the thicknesses of the different layers being exaggerated for clarity.

DETAILED DESCRIPTION OF THE DISCLOSURE

Figure 1:
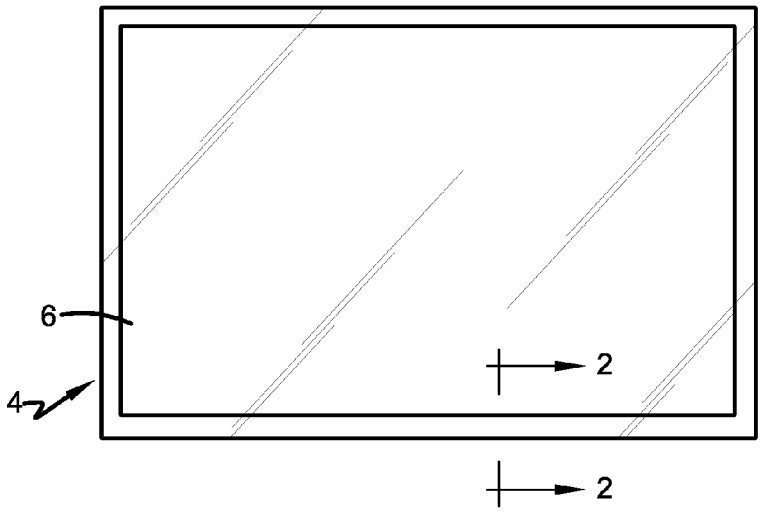
FIG. 1 PRIOR ART
FIG. 1 is a front view of an exemplary prior art insulating glazing unit made from two sheets of glass separated from each other by an exemplary prior art spacer to define an insulating chamber.

Exemplary spacer assembly configurations are depicted in FIGS. 3-8 and are each indicated generally by the reference numeral 100. In each configuration 100, the primary adhesive 102 used to connect spacer assembly 100 to the glazing structures has low MVTR which is an improved (reduced) MVTR compared to the acrylic adhesive described above with reference to FIGS. 1 and 2. Primary adhesive 102 comprises polymers where butyl rubber and/or polyisobutylene polymers together or alone make up the majority of the polymers. The adhesive may also comprise other materials as needed to make it pressure sensitive and to impart a water resistant bond to glass glazing structures. The adhesive may be desiccated. The adhesive can elongate and stretch without significantly changing in permeability to argon gas or moisture. Primary adhesive 102 may be a hot melt. Examples of primary adhesive 102 are EDGETHERM® PIB-H1 (ASTM F 1249 0.45 g/m$^2$/d 0.060" fi lm, 100° F., 100% RH) and EDGETHERM® JS-780 (ASTM F 1249 0.13/m$^2$/d (0.060" fi lm, 100° F., 100% RH). Another example is EDGETHERM® THM 3000 (Water Vapor Transmission Rate 0.01 gms/m$^2$/per 24 hours Hg, (ASTM E 96, procedure E), permeance (0.20 mm thickness)). The layers of primary adhesive 102 are provided in thicknesses from about 0.050 mm (0.002 inches) to about 1.524 mm (0.060 inches). The thicker applications are used to compensate for spacer bodies 104 that are not perfectly square by being applied to the outer opposed faces and then squared off such that, in cross section, adhesive layer 102 has a varying thickness that compensates for the angle of spacer body 104. In these configurations, each layer of adhesive may be triangular or trapezoidal (irregular) in cross section. When used to compensate for spacer body 104 geometry, primary adhesive 102 is applied in a layer having a thickness from about 0.254 mm (0.010 inches) to about 1.524 mm (0.060 inches) with a preferred thickness range from about 0.508 mm (0.020 inches) to about 1.016 mm (0.040 inches) and layers from about 0.762 mm (0.030 inches) to about 1.016 mm (0.040 inches) are believed to provide good geometry compensating properties. Primary adhesive 102 also may be used to compensate for geometry variations along the longitudinal length of the spacer body. In these situations, primary adhesive 102 is applied to the opposing faces of spacer body 104 and then passed through a die or a pair of knives to fix the width of the adhesive and square spacer assembly 100.

Spacer body 104 typically, but optionally, carries a desiccant. Spacer body 104 is a flexible or semi-rigid foam material manufactured from thermoplastic or thermosetting plastics in the form of an elongated strip. Spacer body also may be a solid material or a foam with a solid skin 110. Suitable thermosetting plastics include silicone and polyurethane. Silicone foam rubber is a common material for spacer body 104. Suitable thermoplastic materials include thermoplastic elastomers. The advantages of the silicone foam rubber include: good durability, minimal outgassing, low compression set, good resilience, high temperature stability and cold temperature flexibility. A further advantage of the silicone foam rubber is that the material is moisture permeable and so moisture vapor can easily reach the desiccant material within the foam. Spacer body 104 also may be made from cellular material which may be synthetic or naturally occurring. In the instance where the cellular material is composed of a naturally occurring material, cork and sponge may be suitable examples and in the synthetic version, suitable polymers including, but not limited to polyvinyl chlorides, polysilicone, polyurethane, polypropylene, polyethylene, polystyrene among others are suitable examples.

Each spacer body 104 depicted in the drawings is a flexible strip having a generally rectangular cross section. Spacer body 104 can have a height that is less than its width with the width defining the space between the inner surfaces of the glazing structures. Right angled corners and constant dimensions along its length are desired although variations can be compensated for by primary adhesive 102 as described above. Each spacer body 104 includes opposed faces (top and bottom surfaces of spacer body 104 in the drawings) that are adhered to the inner surfaces of the glazing structures. The opposed faces may come into direct contact with the inner surface of the glazing surfaces or may be spaced from these surfaces by a layer of adhesive. Each spacer body 104 has an inner face (right side surface of spacer body 104 in the drawings) that is exposed to the inner insulating chamber of the insulating glazing unit when spacer assembly 100 is used to form an insulating glazing unit in the manner shown in FIG. 2. Each spacer body 104 also has an outer surface (left side surface of spacer body 104 in the drawings) that is often covered by a vapor barrier 14.

Figure 6:
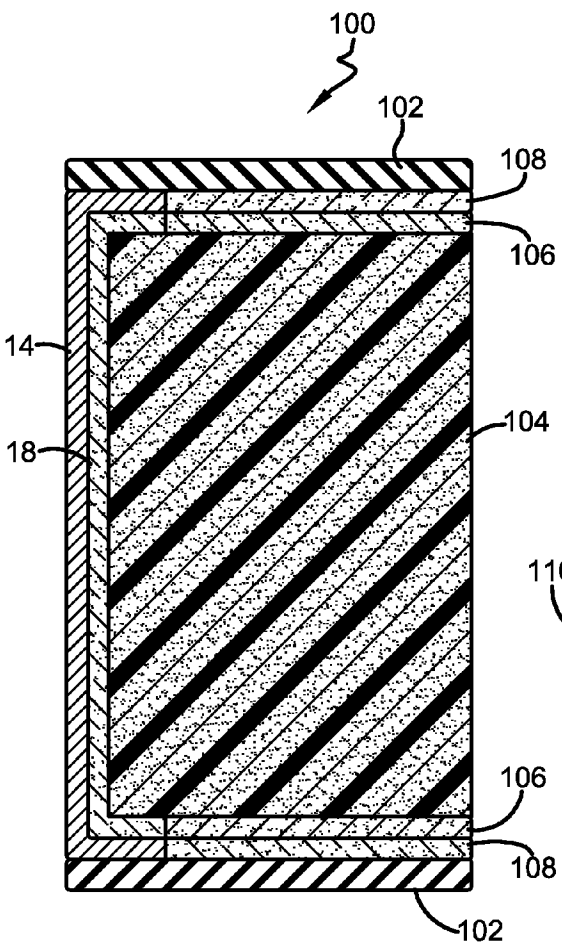
FIG. 6 is a cross section of a fourth exemplary spacer assembly configuration.

In each of these spacer assembly configurations, the disclosure provides one configuration wherein the surface to which adhesive is applied is coated with a layer of primer 106 that improves the adhesion of adhesive 102. Exemplary primers are Primer 94 (3M, St. Paul, Minn.), Chemlok® AP-133 (Lord Corporation, PA), and Chemlok® 607 (Lord Corporation, PA). Primer 106 may be used in each location of adhesive 102 described below. Primer 106 may promote the adhesion of primary adhesive 102 to spacer body 104 or to barrier 14. Although FIG. 6 is the only drawing showing a separate layer of primer 106, primer 106 may be used between adhesive 102 and spacer body 104 in the configurations of FIGS. 3, 4, 5, and 7.

In each of these spacer assembly configurations, the disclosure also provides an alternative wherein an adhesive tie layer 108 is provided under adhesive 102. Tie layer 108 can be used with or without primer layer 106. When primer 106 is used, adhesive tie layer 108 is disposed between primer layer 106 and adhesive 102. Tie layer 108 is used when spacer body 104 is a silicone and primary adhesive 102 does not readily adhere to silicone. Tie layer 108 is provided in thicknesses from about 0.050 mm (0.002 inches) to about 1.524 mm (0.060 inches). An adhesive tie layer 108 that is believed to be useful for improving the adhesion of adhesive 102 to a silicone spacer body 104 includes a mixture of a silicone functional amorphous polyalphaolefin (APAO), a hydrocarbon resin, a paraffinic process oil, and an epoxy-functional silane. Filler such as carbon black may be added.

In one example, adhesive tie layer 108 includes:

1. 40% Vestoplast 206V—Silicone Functional APAO (Evonik)
2. 25% Escorez 1302—Hydrocarbon Resin (ExxonMobil)
3. 10% Sunpar 2280—Paraffinic Process Oil (Holly Refining & Marketing)
4. 24% Raven 890—Carbon Black (Columbian Chemicals)
5. 01% Silquest A-187—Epoxy-functional silane (Momentive)

Figure 2:
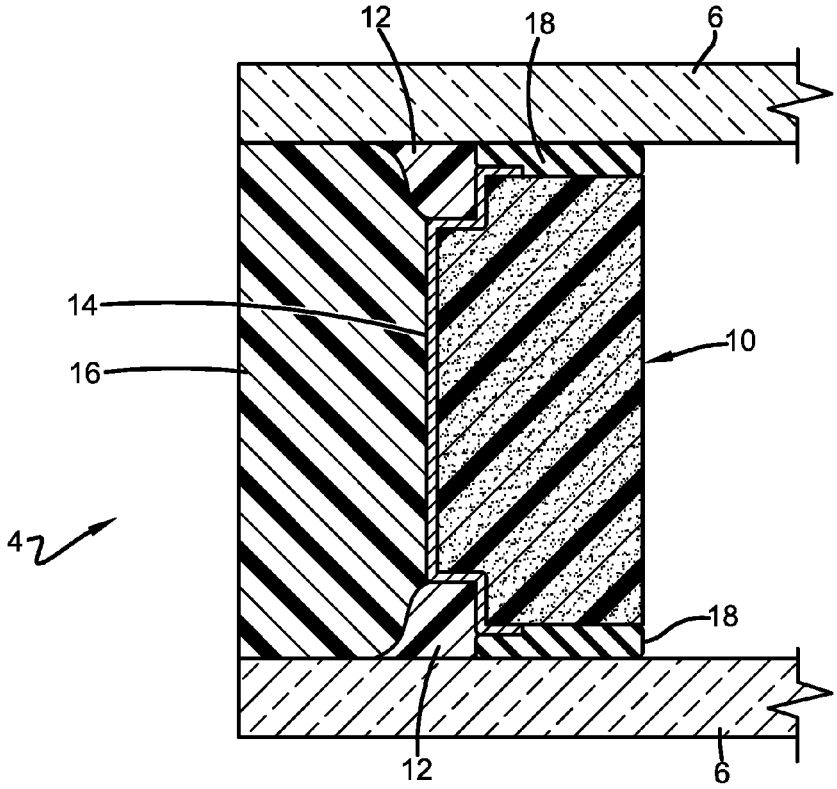
FIG. 2 PRIOR ART
FIG. 2 is a cross section taken along line 2-2 of FIG. 1 shown the exemplary prior art spacer.

FIGS. 3-8 depict different spacer assembly configurations 100 wherein the moisture vapor transmission rate of the material disposed directly between spacer body 104 and the glazing structures at the opposing faces of spacer body 104 is improved compared to the prior art acrylic shown in FIG. 2.

Each of these embodiments includes a spacer body 104 and an adhesive 102 as described above. Some of the embodiments use a moisture vapor barrier 14 secured to spacer body 104 with an adhesive 18 (such as an acrylic adhesive) as described with respect to FIGS. 1 and 2.

Figures 3, 4, 5:
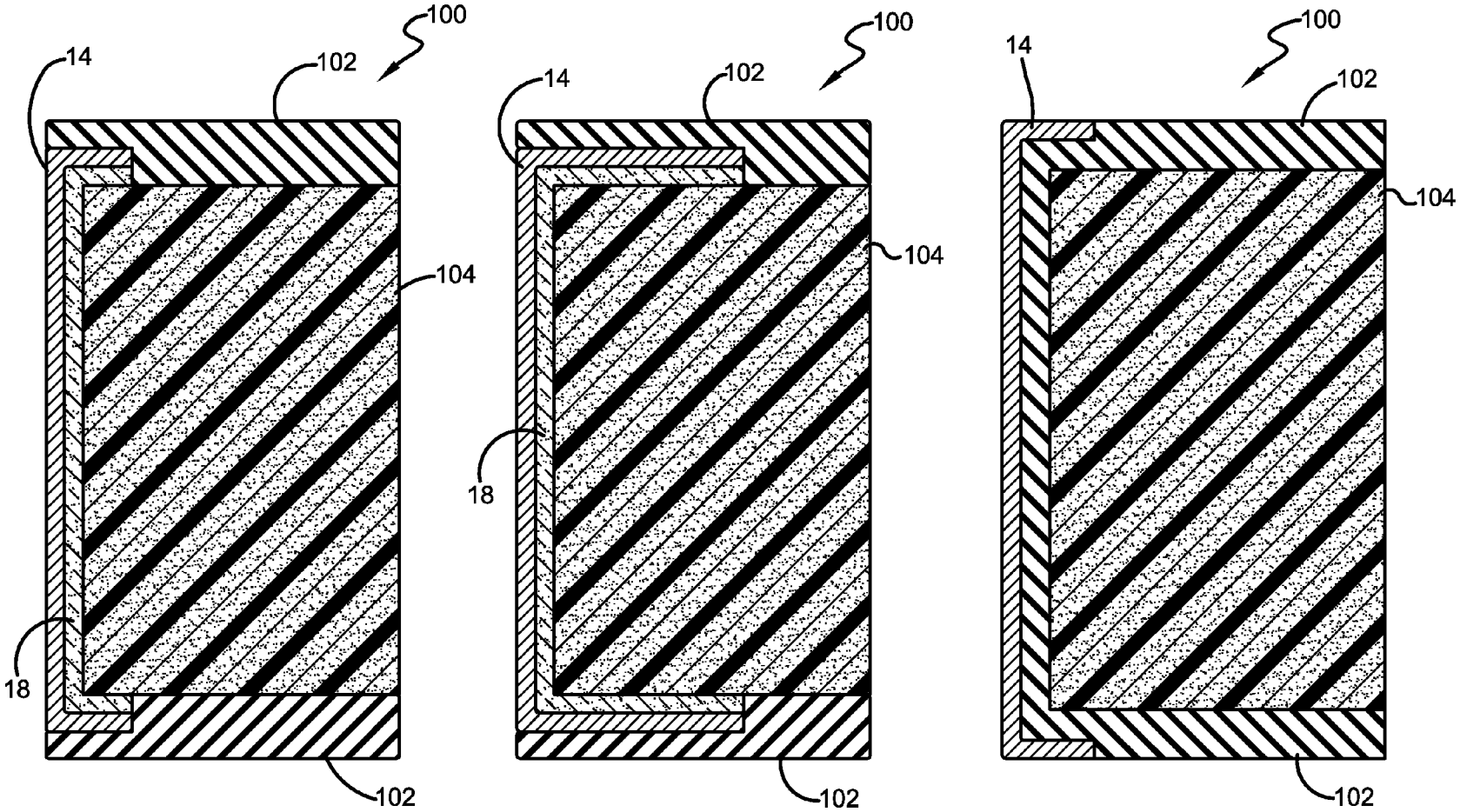
FIG. 3 is a cross section of a first exemplary spacer assembly configuration.
FIG. 4 is a cross section of a second exemplary spacer assembly configuration.
FIG. 5 is a cross section of a third exemplary spacer assembly configuration.
Figure 8:
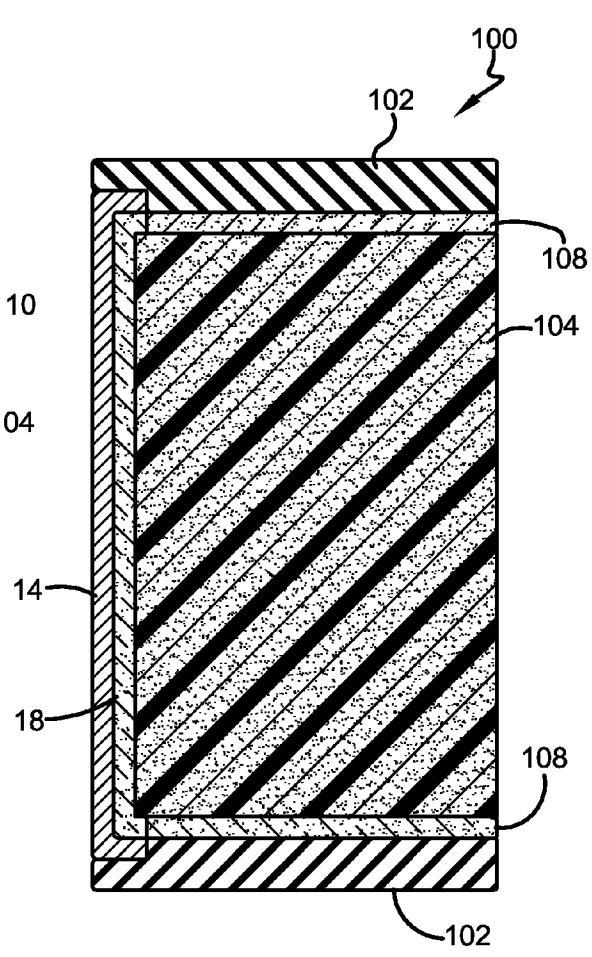
FIG. 8 is a cross section of a sixth exemplary spacer assembly configuration.

In the exemplary configurations of FIGS. 3 and 8, spacer body 104 has a moisture vapor barrier 14 connected to its outer surface with an acrylic adhesive 18. Barrier 14 and adhesive 18 are turned up over the outer corners to define turn-up portions that extend less than one quarter of the height of spacer body 104. These turn up portions may be extended to a height that is less than half but more than a quarter of the spacer body height or to a height that is more than half the spacer body height as described below. Primary sealant 102 is disposed over these turn up portions and against the opposed faces of spacer body 104 in layers having thickness from about 0.254 mm (0.010 inches) to about 1.524 mm (0.060 inches) with a preferred thickness range from about 0.762 mm (0.030 inches) to about 1.524 mm (0.060 inches). When spacer body 104 is a silicone material, a layer of tie material 108 is used between primary adhesive 102 and the opposed faces of spacer body 104. FIG. 8 depicts the tie material 108. In the FIG. 8 configuration, tie material 108 is an acrylic adhesive exactly the same as layer 18 or similar to layer 18. Primer 106 may be used in a further alternative configuration. Primer 106 is applied directly to spacer body 104.

In the exemplary configuration of FIG. 4, spacer body 104 has a moisture vapor barrier 14 connected to its outer surface with an acrylic adhesive 18. Barrier 14 and adhesive 18 are turned up over the outer corners to define turn-up portions that extend over half of the height of spacer body 104.

Primary sealant 102 is disposed over these turn up portions and against the opposed faces of spacer body 104 in layers having thickness from about 0.254 mm (0.010 inches) to about 1.524 mm (0.060 inches) with a preferred thickness range from about 0.762 mm (0.030 inches) to about 1.524 mm (0.060 inches). When spacer body 104 is a silicone material, a layer of tie material 108 is used between primary adhesive 102 and the opposed faces of spacer body 104. Primer 106 may be used in a further alternative configuration.

In the exemplary configuration of FIG. 5, spacer body 104 has a moisture vapor barrier 14 connected to its outer surface with a layer of the primary adhesive that wraps around the outer surface of spacer body 104. Barrier 14 is turned up around the corners to a height as described above. Primary sealant 102 is disposed against the opposed faces of spacer body 104 (but not over the turn ups) in layers having thickness from about 0.254 mm (0.010 inches) to about 1.524 mm (0.060 inches) with a preferred thickness range from about 0.762 mm (0.030 inches) to about 1.524 mm (0.060 inches). When spacer body 104 is a silicone material, a layer of tie material 108 is used between primary adhesive 102 and the opposed faces of spacer body 104. Primer 106 may be used in a further alternative configuration. In this configuration, the turn up portions of barrier 14 are disposed directly against the inner surfaces of the glazing structures.

In the exemplary configuration of FIG. 6, a flexible, desiccated, silicone foam rubber spacer body 104 has a moisture vapor barrier 14 connected to its outer surface with an acrylic adhesive 18. Barrier 14 and adhesive 18 are turned up over the outer corners to define turn-up portions that extend less than one quarter of the height of spacer body 104. This drawing depicts the use of primer 106 against the opposed faces of spacer body 104 with a layer of tie material 108 disposed over primer 106. Primary sealant 102 is disposed over the turn up portions and against tie material 108. The layers of primary adhesive 102 are provided in thicknesses from about 0.050 mm (0.002 inches) to about 1.524 mm (0.060 inches) and may be in layers having thickness from about 0.254 mm (0.010 inches) to about 1.524 mm (0.060 inches) with a preferred thickness range from about 0.762 mm (0.030 inches) to about 1.524 mm (0.060 inches). When spacer body 104 is a silicone material, a layer of tie material 108 is used between primary adhesive 102 and the opposed faces of spacer body 104.

Figure 7:
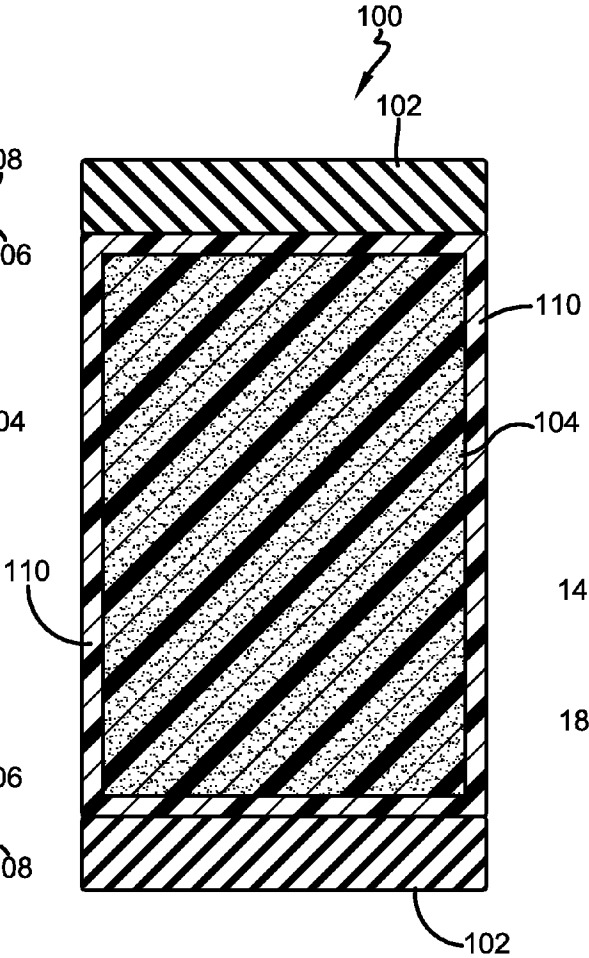
FIG. 7 is a cross section of a fifth exemplary spacer assembly configuration.

In the exemplary configuration of FIG. 7, spacer body 104 has a foam core surrounded by a skin 110 of solid material. Primary sealant 102 is disposed against the opposed faces of skin 110. The layers of primary adhesive 102 are provided in thicknesses from about 0.050 mm (0.002 inches) to about 1.524 mm (0.060 inches) and may be in layers having thickness from about 0.254 mm (0.010 inches) to about 1.524 mm (0.060 inches) with a preferred thickness range from about 0.762 mm (0.030 inches) to about 1.524 mm (0.060 inches). When spacer body 104 is a silicone material, a layer of tie material 108 is used between primary adhesive 102 and the opposed faces of spacer body 104. Other materials as described above may be used for spacer body 104. The configuration of spacer body 104 having the skin 110 tends to have non-uniform geometry during manufacturing and primary adhesive 102 may be used to compensate the non-uniform geometry problems in this configuration.

In the foregoing description, certain terms have been used for brevity, clearness, and understanding. No unnecessary limitations are to be implied therefrom beyond the requirement of the prior art because such terms are used for descriptive purposes and are intended to be broadly construed. Moreover, the above description and attached illustrations are an example and the invention is not limited to the exact details shown or described. Throughout the description and claims of this specification the words "comprise" and "include" as well as variations of those words, such as "comprises," "includes," "comprising," and "including" are not intended to exclude additives, components, integers, or steps.

The invention claimed is:

1. A spacer assembly for insulating glazing units; the spacer assembly comprising:

a silicone foam rubber spacer body having opposed faces and an outer face extending between the opposed faces; the opposed faces adapted to be connected to glazing structures of an insulating glazing unit;

a primary adhesive adapted to adhere the spacer body to glazing structures; and an adhesive tie layer disposed between the opposed faces of the spacer body and the primary adhesive to adhere the primary adhesive to the spacer body.

2. The spacer assembly of claim 1, wherein the primary adhesive includes polymers; and wherein a majority of the polymers of the primary adhesive comprise at least one of butyl rubber and polyisobutylene polymers.

3. The spacer assembly of claim 1, further comprising a moisture vapor barrier disposed along the outer face of the spacer body.

4. The spacer assembly according to claim 1, wherein the adhesive tie layer is an acrylic adhesive.

5. The spacer assembly of claim 1, wherein the silicone foam rubber is permeable and includes a desiccant.

6. A spacer assembly for insulating glazing units; the spacer assembly comprising:

a silicone foam rubber spacer body having opposed faces and an outer face extending between the opposed faces;

an adhesive tie layer adhered to each of the opposed faces of the spacer body; and a primary adhesive adhered to the adhesive tie layer;

a moisture vapor barrier disposed along the outer face of the spacer body; and wherein outer corners of the spacer body are defined at the junctions of the outer face and the opposed faces and the moisture vapor barrier is turned up around the outer corners of the spacer body to a height that is more than half of a height of the spacer body.

7. The spacer assembly according to claim 6, wherein portions of the moisture vapor barrier are disposed along the opposed faces of the spacer body to define turned up portions and wherein the primary adhesive is disposed on the turned up portions.

8. The spacer assembly according to claim 6, wherein the moisture vapor barrier is connected to the spacer body with an adhesive.

9. The spacer assembly according to claim 8, wherein the adhesive connecting the moisture vapor barrier to the spacer body is an acrylic adhesive.

10. The spacer assembly according to claim 8, wherein the adhesive connecting the moisture vapor barrier to the spacer body is the primary adhesive.

11. The spacer assembly of claim 6, wherein the silicone foam rubber spacer body is permeable and includes a desiccant.

12. A spacer assembly for insulating glazing units; the spacer assembly comprising:

a silicone foam rubber spacer body having opposed faces and an outer face extending between the opposed faces;

an adhesive tie layer adhered to each of the opposed faces of the spacer body;

a primary adhesive adhered to the adhesive tie layer; and further comprising a primer between the adhesive tie layer and the spacer body.

13. The spacer assembly of claim 12, wherein the primary adhesive has a thickness from about 0.050 mm to about 1.524 mm thick.

14. The spacer assembly of claim 12, wherein the adhesive has a thickness from about 0.254 mm to about 1.524 mm.

15. The spacer assembly of claim 12, wherein the silicone foam rubber spacer body is permeable and includes a desiccant.

16. The spacer assembly of claim 15, further comprising a moisture vapor barrier disposed along the outer face of the spacer body.

17. A spacer assembly for insulating glazing units; the spacer assembly comprising:

a silicone foam rubber spacer body having opposed faces and an outer face extending between the opposed faces to define a pair of outer corners of the spacer body;

a tie layer adhered to each of the opposed faces of the spacer body;

a primary adhesive adhered to the tie layer; and wherein the tie layer includes a mixture of a silicone functional amorphous polyalphaolefin, a hydrocarbon resin, a paraffinic process oil, and an epoxy-functional silane.

18. The spacer assembly according to claim 17, wherein the tie layer includes filler.

19. The spacer assembly according to claim 17, wherein the silicone functional amorphous polyalphaolefin makes up about 40 percent of the tie layer.

20. The spacer assembly of claim 17, wherein the silicone foam rubber spacer body is permeable and includes a desiccant.

21. A spacer assembly for insulating glazing units; the spacer assembly comprising:

a silicone foam rubber spacer body having opposed faces and an outer face extending between the opposed faces;

a primary adhesive adapted to adhere the spacer body to glazing structures; the primary adhesive including polymers; and wherein a majority of the polymers of the primary adhesive comprise at least one of butyl rubber and polyisobutylene polymers; and a primer disposed between the primary adhesive and the spacer body to promote adhesion of the primary adhesive to the spacer body.

22. The spacer assembly of claim 21, wherein the silicone foam rubber spacer body is permeable and includes a desiccant.

23. A spacer assembly for insulating glazing units, comprising:

an elongated spacer body having opposed faces; the opposed faces being non-parallel to each other to define non-parallel geometry; and a layer of primary adhesive disposed on each of the opposed faces; each layer of primary adhesive having a thickness sufficient to compensate for the non-parallel geometry of the opposed face on which the layer of primary adhesive is disposed; each layer of primary adhesive having a thickness from about 0.254 mm to about 1.524 mm thick.

24. The spacer assembly of claim 23, wherein each layer of primary adhesive has a thickness from about 0.508 mm to about 1.016 mm.

25. A spacer assembly for insulating glazing units; the spacer assembly comprising:

a spacer body having opposed faces and an outer face extending between the opposed faces;

a primary adhesive disposed along the opposed faces;

a moisture vapor barrier connected to the outer face of the spacer body;

the moisture vapor barrier being connected to the spacer body with the primary adhesive.

26. The spacer assembly of claim 25, further comprising an adhesive tie layer disposed between each of the opposed faces of the spacer body and the primary adhesive.

* * * * *